US005803178A

United States Patent [19]

Cain

[11] Patent Number: 5,803,178

[45] Date of Patent: Sep. 8, 1998

[54] DOWNWELL ISOLATOR

[75] Inventor: Michael A. Cain, Bakersfield, Calif.

[73] Assignee: Union Oil Company of California, El Segundo, Calif.

[21] Appl. No.: 712,922

[22] Filed: Sep. 13, 1996

[51] Int. Cl.[6] ..... E21B 43/24

[52] U.S. Cl. ..... 166/306; 166/50

[58] Field of Search ..... 166/263, 306, 166/369, 373, 375, 50

[56] References Cited

U.S. PATENT DOCUMENTS

| | | | |
|---|---|---|---|
| 2,629,447 | 2/1953 | Nebolsine | 166/306 |
| 2,706,526 | 4/1955 | Van Der Beemt | 166/306 |
| 4,531,581 | 7/1985 | Pringle et al. . | |
| 4,548,264 | 10/1985 | Manderscheid | 166/139 |
| 4,565,245 | 1/1986 | Mims et al. | 166/306 X |
| 4,640,359 | 2/1987 | Livesey et al. | 166/306 X |
| 4,709,758 | 12/1987 | Preston, Jr. | 166/120 |
| 4,828,031 | 5/1989 | Davis | 166/272 |
| 5,024,275 | 6/1991 | Anderson et al. | 166/306 X |
| 5,085,276 | 2/1992 | Rivas et al. | 166/303 |
| 5,311,939 | 5/1994 | Pringle et al. . | |
| 5,472,050 | 12/1995 | Rhoten et al. | 166/250.1 |

*Primary Examiner*—William P. Neuder
*Attorney, Agent, or Firm*—Gregory F. Wirzbicki; William O. Jacobson

[57] ABSTRACT

A slidably sealing isolator and method for using the isolator in a wellbore tubular to control the injection and production of fluids to individual formation zones, the isolator having 1) a sliding band seal which does not need to be actuated or set in order to restrict fluid flow into a wellbore zone and is capable of slidably sealing at threaded joint portions of the wellbore tubular, and 2) a wellbore flow control means.

28 Claims, 4 Drawing Sheets

DOWNWELL ISOLATOR

FIELD OF THE INVENTION

This invention relates to underground well devices and processes. More specifically, the invention is concerned with an economic method and device to isolate fluid flow into or out of one or more subsurface zones penetrated by an underground well.

BACKGROUND OF THE INVENTION

Many underground wells penetrate more than one geological formation, distinct portions of a formation, lenses within a formation, or other underground zones having significantly different fluid permeability properties. In some of these wells, both the injection of fluids into and the withdrawal of fluids from more than one zone are desired. For example, thermal recovery operations for an oil producing well may entail the injection of steam or other thermal fluid into several oil-containing zones followed by oil and steam condensate production from these zones. This type of thermal recovery operation from a well is sometimes referred to as a huff and puff cycle. In other types of formation fluid recovery operations, fracture or solvent fluids are injected into one or more zones followed by formation fluid recovery from the well.

Unfortunately with current technology, controlling the amounts of fluid injected into and/or withdrawn from each zone may not be economically feasible. For example, a thermal recovery operation in which steam is injected into a perforated wellbore tubular penetrating a shallow, highly permeable production zone and a deeper, low permeability production zone will frequently result in the steam being essentially injected only into the shallow permeable zone unless other means are used to control fluid flows within the wellbore adjacent to each zone, i.e., to control zonal fluid flow within the wellbore.

A typical method of controlling fluid flow within a thermal recovery wellbore is to use high temperature and/or high pressure packers to isolate zonal portions of the well. The high pressure/high temperature injection fluids (e.g., typically steam at a temperature more than about 400° F., more typically at greater than about 500° F., even more typically at greater than about 600° F.) as well as high temperature/high pressure fluids produced from deep formations can cause substantial strength degradation for many elastomers, forcing the use of packers specifically designed for high pressure and temperature applications. For example, many relatively simple inflatable packers cannot be used, and relatively complex, actuating mechanism packers must be used.

The complex packers typically have expanding mechanism elements that must be actuated to seal and/or set the packer within the wellbore in order to restrict flow to a wellbore portion proximate to a zone. The high temperature packer is typically lowered on a tubing string to a location, e.g., just above a deep, low permeability zone, and actuated to expand and set (or be securably attached) to the wellbore tubular wall at the contacting location. The set packer is expected to seal off steam flow to the upper zone(s) when injecting steam or other thermal fluid through the tubing string to the deep zone. Attachment and sealing capability must then be verified by pressure testing or other means. After the steam or other fluid is injected into the deep zone, the packer may be deactuated, reactuated, reset and tested (e.g., to account for differential thermal expansion when oil instead of steam is flowing) or removed and repeatedly reset, reactuated, and tested when fluid flow to only the deeper zone is again desired, e.g., after steam-heated oil has been produced and additional steam is needed to heat the next portion of formation oil to be produced. Actuating forces may be applied to the packer by axial or circular movement of packer-connected tubing, fluid pressure, electrical, or other means. Actuating mechanisms can include piston-type actuators, mandrels, and hydraulic bladders.

The cycle of lowering, actuating, setting, testing, deactuating, and removing packers consumes valuable time and resources which may not be economically justified for the amount of oil which may be recovered from a low permeability zone during one thermal recovery cycle. In addition, thermal expansion, corrosion, deposits, and other multiple fluid handling problems have resulted in packer damage, seal failure and other problems. This is especially true for "dirty" applications where produced formation fluids and particles or other materials can corrode, clog, or jam actuating mechanisms and cause other major failures.

SUMMARY OF THE INVENTION

The present invention avoids such thermal expansion, releasably setting, and other downhole problems encountered with the use of conventional packers to isolate portions of the well and thereby control fluid flow into or out of a zone by using a slidable isolator apparatus having: 1) a sliding band seal which does not need to be actuated or set within a wellbore in order to restrict fluid flow around the isolator; and/or 2) a flow passage and flow control means to restrict or allow fluid flow through the isolator. Like prior art packers set in a wellbore at a location between zones, the present invention restricts fluid flow between portions of the wellbore tubular proximate to different subsurface zones, but the sliding seal avoids the need for an actuating mechanism. The sliding band seal also allows sealing at jointed sections of the wellbore tubular and simple sliding of the isolator within the wellbore tubular if repositioning is required. Flow control means, such as a ball valve in a separate passageway, can avoid the need for packer removal in order to produce fluids from other zones, e.g., controlling and/or restricting the amount of injected fluid into a zone while allowing production of formation fluids from more than one zone without removal of the isolator. The slidable seal isolator and the method of using it provides an economic means for increasing oil production from zones requiring fluid injection as part of a secondary or tertiary recovery method, especially for wellbore penetrated zones having significantly different permeabilities.

BRIEF DESCRIPTION OF THE DRAWINGS

In these Figures, it is to be understood that like reference numerals refer to like elements or features.

DETAILED DESCRIPTION OF THE INVENTION

Figure 1:
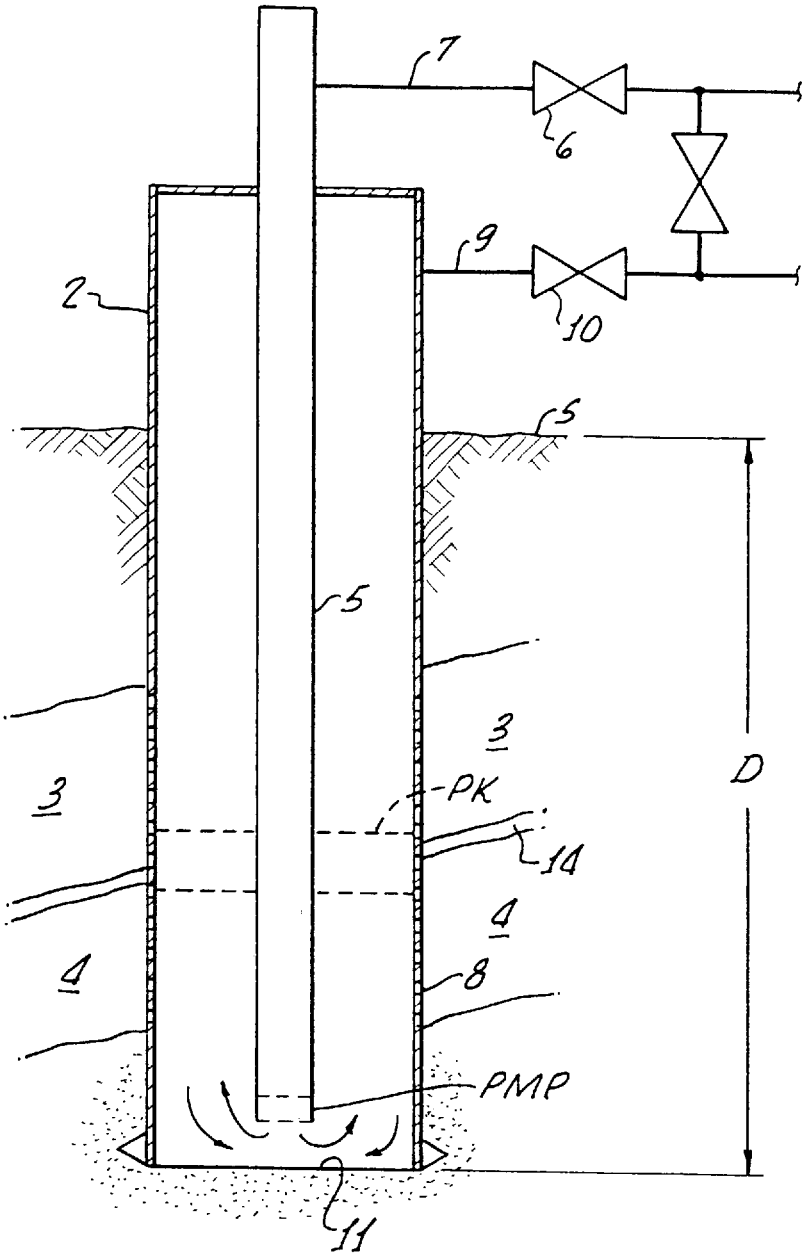
FIG. 1. (PRIOR ART)
FIG. 1 shows a cross sectional view of a wellbore tubular assembly penetrating two geological zones.

FIG. 1 shows a schematic cross-sectional view of a conventional "huff & puff" well system for producing heavy oil. The system includes an outer conductor, casing, liner, or other wellbore tubular assembly 2 which is perforated in portions which penetrate two subsurface oil-bearing formations or other types of zones 3 and 4 (separated by non-producing zone 14) and inner conductor or tubing 5 to conduct one or more fluids, e.g., a $CO_2$ solvent or a thermal recovery fluid such as steam. Steam is typically generated by a boiler or other steam generating system (not shown for clarity) which is well known to those skilled in the art. Generated steam is injected through steam valve 6 and steam injection piping 7 into tubing 5 from where it flows out from the bottom and into zones 3 and 4 through perforations 8 in tubular assembly 2.

Although the wellbore tubular assembly 2 and tubing 5 are shown having a constant diameter extending from a surface location "S" to a location near the well bottom 11 at a depth "D" below the surface "S," those skilled in the art will appreciate that the tubular assembly 2 and/or tubing 5 may be composed of strings of different diameter sections. Strings may include a large diameter surface conductor string, a smaller diameter casing string and a still smaller diameter perforated liner string. In addition, perforations 8 may be in separate tubular sections, especially when zones 3 and 4 are significantly separated by a substantial clay or other non-producing layer 14. The nominal diameter of the tubular assembly 2 can typically range from as little as about 2⅜ inches to as much as about 30 inches, but the diameter of the tubular located at formation fluid producing zones of interest more typically ranges from about 5 to 13 inches.

Casing sections or other portions of the tubular assembly 2, tubing 5, or other ducting in a wellbore exposed to thermal recovery operations is typically composed of steel, but may also be composed of other metals, certain non-metallic materials, or other compositions which can withstand the high temperature environment and exposure to formation fluids which are sometimes corrosive. Although tubing 5 can vary widely in diameter, it typically ranges from about 2⅜ inches (allowing the passage of small wireline tools) to as much as about 8 inches in nominal outside diameter, but more typically has a nominal diameter of less than about 3½ inches.

Perforations 8 adjacent to oil or other fluid-bearing zones (i.e., zones of interest) 3 and 4 are created in the tubular assembly 2 using methods well known to those skilled in the art. For example, perforations 8 can be produced by 1) using slotted or other pre-perforated tubulars and running the pre-perforated tubulars into the wellbore, 2) using guns or other post-installation perforating devices after tubulars are installed, or 3) using a combination of 1) and 2). A gravel-pack between the wellbore tubular assembly 2 and formations 3 & 4 is not shown, but may also be present in some applications.

Oil, natural gas, geothermal brine, mineral-laden water, or other formation fluids are produced from underground zones 3 and 4, through the perforations 8 into the annulus portion between tubing 5 and tubular assembly 2 to production piping 9 and production valve 10 before being transmitted to a fluid production collection and/or pipeline system (not shown for clarity). Such production systems are well known to those skilled in the art.

The shallow zone 3 typically has a greater permeability than the deeper zone 4. Sometimes the permeability differences can be significant, e.g, a lower zone air permeability of 100 millidarcies and an upper zone air permeability of 200–1000 millidarcies. These permeability differences, especially 10 to 1 permeability differences, have precluded the economic recovery of formation fluids from the lower zone.

Even though the tubing 5 extends nearly the entire depth "D" from surface "S" to near the bottom of the deeper zone 4, the flow of a solvent, thermal, or other injection fluid such as steam from the tubing through perforations 8 into the shallow zone 3 is typically substantially greater than the flow of steam or other fluid into the deeper zone 4 because of the permeability differences between the shallow and deeper zones. This is in spite of the potentially greater steam pressure at the perforations 8 adjacent to the deeper zone 4 because of the near bottom location of the discharge end of tubing 5. Also, the radial penetration of injected steam into the deeper, low permeability zone 4 may be much less than that in the upper, greater permeability zone 3 because of pressure/density changes making fluid flow more difficult in zone 4 and the lower flow rate into zone 4 resulting in the steam being quickly cooled and condensed. Thus, when the production of solvent-thinned oil or steam heated oil or other modified formation fluids is desired (e.g., steam injection valve 6 is closed and production valve 10 is opened), little production of heated oil or other formation fluids is obtained from the deeper formation 4.

In a test of steam injection into a portion of wellbore tubulars proximate to different permeability zones similar to zones 3 and 4 shown in FIG. 1, only approximately 4 percent of the injected steam entered into the deeper zone 4 while the more permeable shallow zone 3 received 96 percent of the total injected steam. The poor deep-zone injection results were in spite of the fact that the deeper zone 4 was approximately twice as thick as the shallow or "thief" zone 3.

If control of the amount of steam injected into each zone is desired, a packer (shown dotted in FIG. 1 for clarity as "PK") can be installed in the wellbore tubular at a location between the zones. Packers are well known to those skilled in the art. The first portion of steam to be injected through perforations in the wellbore tubular and into the upper zone 3 can be supplied through piping system 9 to the annulus above the packer "PK." The second portion of steam to be injected into the lower zone 4 can be supplied through piping system 7 and tubing 5 to the annulus below the packer "PK." Because of permeability differences, the flowrate, amount, and duration of steam flow into the lower zone 4 can be significantly different than comparable parameters for the upper zone 3. From the annulus, each injected steam portion flows through perforations 8 in tubular assembly 2 into zone 3 or 4.

After steam or other injection fluid is introduced, the packer PK is removed and formation fluids from zones 3 and 4 may flow up to the surface without pumping, but pumping up through the tubing 5 may be required, e.g., by optional downhole tubing pump "PMP" shown dotted as optional for clarity. Optional tubing pumps are well known to those skilled in the art. If a formation fluid is pumped, the formation fluids from zones 3 and 4 may be commingled in the annulus between tubing 5 and tubular assembly 2 as the fluids drain towards the optional tubing pump "PMP." The dual flow capability (e.g., steam injection and oil production) of tubing 5 is shown by flow arrows near the optional pump "PMP" and bottom of tubing 5.

If optional tubing pump "PMP" is used, the tubing pump may have to be pulled out of the tubing when fluid injection such as steam is desired. Removal of the packer "PK" (e.g., prior to oil production) and pulling of the optional pump "PMP" (e.g., prior to steam injection) may be required once during every thermal cycle.

Figure 2:
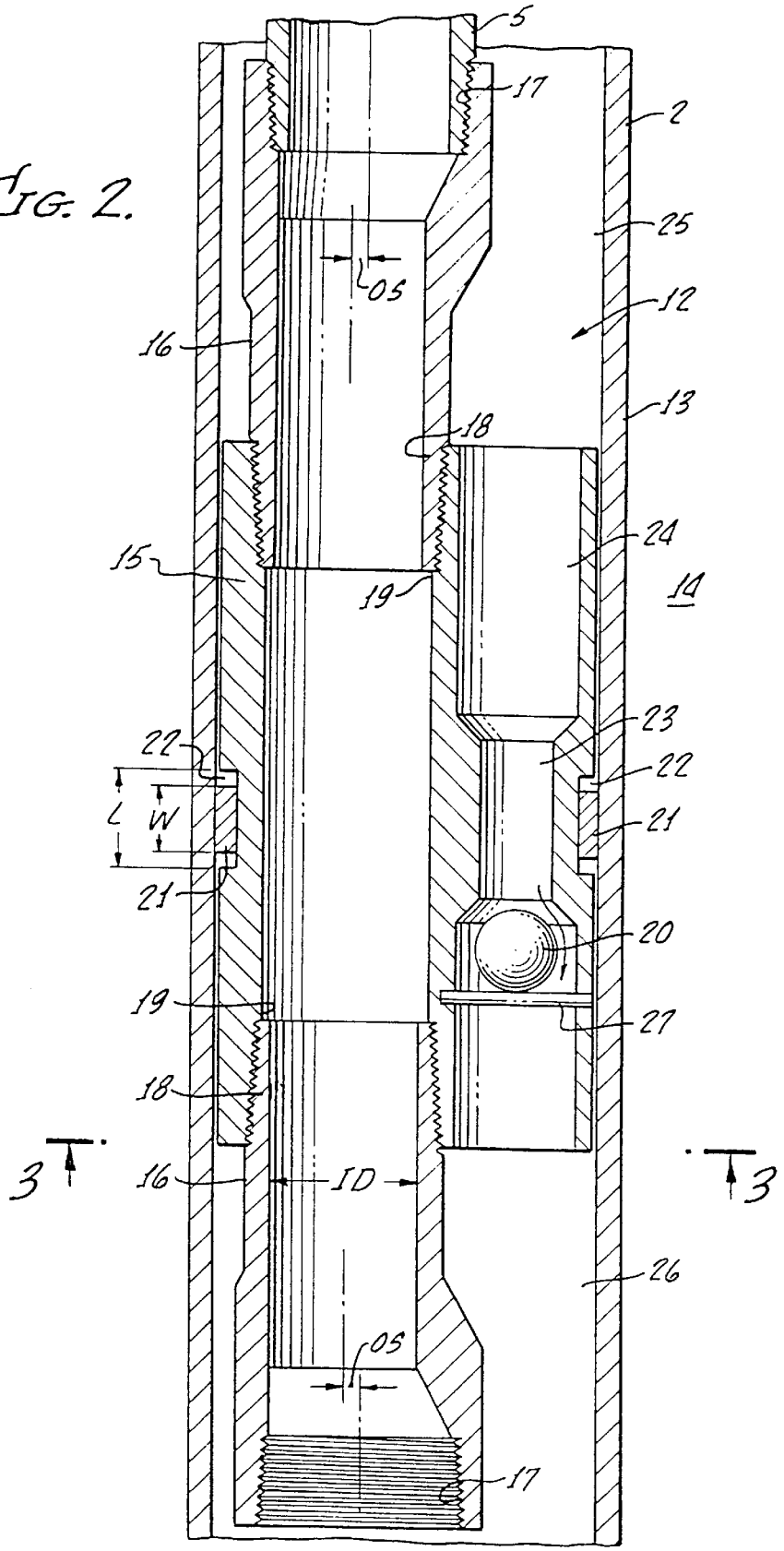
FIG. 2 shows a cross sectional view of the slidable isolator embodiment of the invention located in a wellbore tubular portion.
Figure 4:
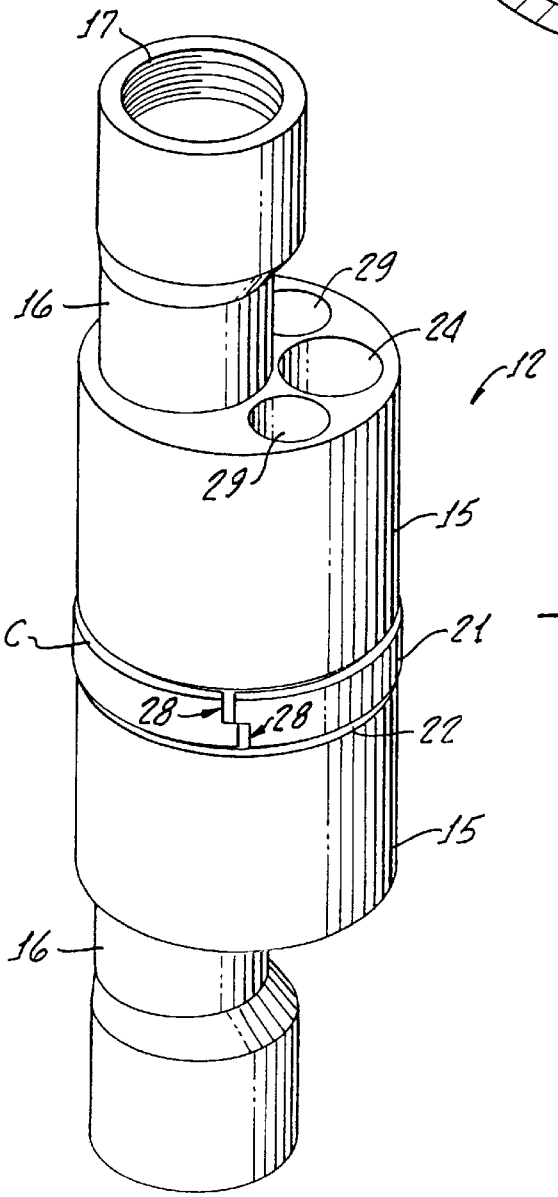
FIG. 4 shows a perspective view of the isolator.

FIG. 2 shows a cross-sectional view of an embodiment of the apparatus of the invention, a slidable seal restrictor or isolator assembly 12 is typically placed within a portion or section 13 of wellbore tubular assembly 2 near a zone boundary or adjacent to a non-producing zone 14. The location of isolator assembly 12 is similar to the location where optional packer "PK" might be placed as shown in FIG. 1, and a perspective view of the isolator assembly 12 is shown in FIG. 4. A gravel pack radially outward from the wellbore tubular assembly 2 is not present or shown in FIG. 2, but may be present in some other applications. The isolator assembly 12 shown in FIG. 2 is located within a tubular section 13, typically a 40 foot long casing or liner section, which is threadably connected to other sections to form tubular assembly or tubular 2.

The isolator assembly 12 shown includes a restrictor or isolator body 15 and two eccentric the eccentric reducers each of the eccentric reducers 16 has a female connector 17 for threadably connecting to threaded portions of tubing 5. Each reducer 16 also has a male connector 18 threadably connecting with threaded port 19 of the isolator body 15. In the embodiment shown, the reducers 16 form a reduced diameter passageway for an injected or produced fluid conducted by the tubing 5, reducing the passageway from about 2⅜ inches nominal tubing size at the female connector end to an "ID" of about 1.61 inches at the male connector end. Other nominal tubing sizes can be used, but sizes are typically less that about 5 inches in nominal diameter. Associated reducers would have comparably smaller ID's as compared to the nominal tubing size, typically ranging from about 5/16 inch to about 4.6 inches in diameter. Other embodiments of the invention combine the isolator body and eccentric reducers into a single element (eliminating the threaded connections), replace the eccentric reducers with a one piece reducer, or replace the threaded connections with press fit, adhesive, welded, or other connections or other means for connecting the eccentric reducers to the isolator body.

Use of the eccentric reducer 16 having an ID of at least about 1.6 inches allows very small wireline tools to be passed through the tubing and below the sliding seal isolator without removing the isolator and makes additional usable space available for a restrictable passageway 24. Small diameter tools can be lowered by wireline within the tubing and the eccentric reducer 16 allows passage and guides the tools and wireline through the laterally displaced and smaller ID portion.

The eccentric reducers 16 also produce a centerline offset or "OS" in fluid flow being conducted in the tubing 5, e.g., an offset of about 0.192 inches in the embodiment shown. The offset increases the size of passageway 24 which transmits fluid through the isolator to the annular regions above and below the isolator. Other embodiments may not include any offset or can produce an offset or "OS" as much as about 2 inches or more, but more typically produce an offset of less than about 1 inch.

The isolator body 15 shown in FIG. 2 comprises at least one flow restrictable port or passageway 24. The isolator body 15 also comprises at least one ball 20 or other means for restricting flow through the restrictable passageway 24. The ball 20 is shown in an "open" position (i.e., a position which does not restrict fluid flow downward between adjacent annuli) in restrictable passageway 24, allowing fluid to flow from above the isolator body 15 in the upper annulus 25 between the tubing 5 and wellbore tubular assembly 2 to the lower annulus 26 below the isolator body 15 as illustrated by flow arrows shown around the ball. When the ball 20 is biased toward or located closer to constricted portion 23 of the restrictable fluid passageway 24 (i.e., if the ball is in a "closed" position), fluid (such as injected steam) from lower annulus 26 below the isolator body 15 is substantially prevented from flowing to the upper annulus 25 above the isolator body, the ball 20 and constricted portion 23 acting as a closed check valve. However, this isolator ball or other check valve assembly embodiment does not prevent fluids (such as oil or other formation fluids) produced from the upper zone 3 from flowing through restrictable passageway 24 to the lower annulus 26 from the upper annulus 25 since the ball opens when reverse pressure gradient/fluid flow is applied.

Figure 5:
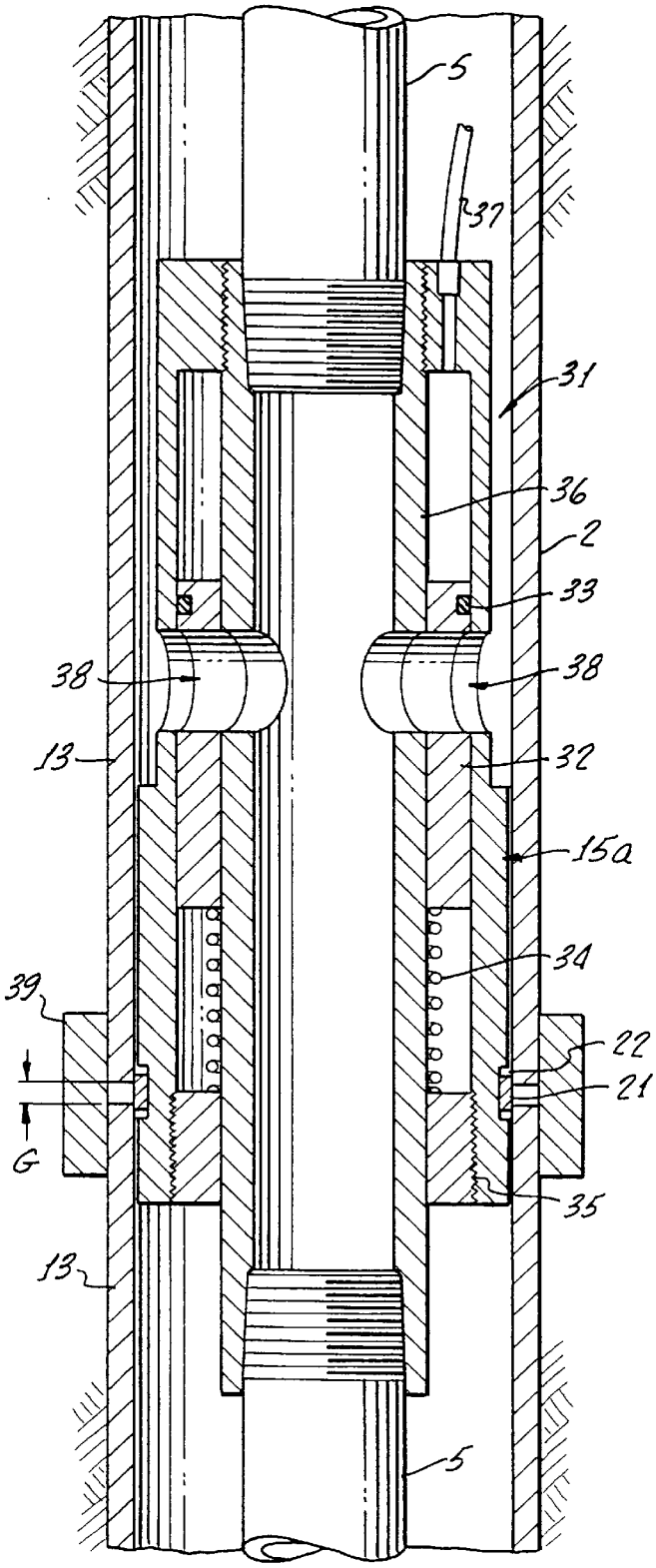
FIG. 5 shows cross sectional view of an alternative slidable isolator embodiment of the invention.

Other means for controlling, isolating, or restricting fluid flow in one or more restrictable passageways under some conditions while allowing fluid flow at other conditions include an actuated control valve (e.g., see FIG. 5), a flapper valve, and a rupture disc. Besides a reversal of pressure gradient/flow direction, actuation of the means for restricting or isolating can include fluid pressure changes in the annulus, changes in control fluid pressure (within separate control fluid lines as shown in FIG. 5), electromagnetic signals, seismic signals, and rotary and/or axial forces applied to the tubing.

As shown in FIG. 2, restrictable passageway 24 has an inside diameter of about 1¼ inches, while its restricted portion 23 has an inside diameter of about ¾ inch. The ball 20 is about ⅞ inch in diameter and is typically composed of a hard metal, such as a tungsten steel alloy. Pin retainer 27 or other ball catch apparatus extends across the restrictable passageway 24, preventing the ball 20 from moving any lower than as shown in the "open" position. Alternative catch embodiments can include a mesh cage, pins or other protrusions extending partially into passageway 24, and magnetic catches. Still other embodiments can include bias elements which also serve as means to restrict motion or catch the ball, including a helical spring and a Bellville spring.

A sealing band or sliding band seal 21 is placed in channel or groove 22 located circumferentially around the outer surface of the body 15. The sliding band seal 21 is typically composed of an elastic metal material, such as spring steel, but may also be composed of coated metals, fiber-reinforced elastomeric materials, and/or high temperature elastomeric materials. The sliding band seal 21 shown in FIG. 2 and FIG. 4 is similar to a split metal ring on a piston in that the sliding band seal 21 allows the isolator body 15 to sealably slide within portion 13 of wellbore tubular assembly 2. Unlike a split piston ring, the sliding band seal 21 has a width "W" to allow it to pass over gaps "G" between sections 13 of the tubular assembly 2 as shown in FIG. 5. In the embodiment shown in FIG. 2, the width "W" is about 4 to 6 inches, which is somewhat greater than the maximum gap between threadably joined 4½ inch nominal pipe sections which form one embodiment of the tubular assembly 2. The width "W" of the sliding band seal 21 of other embodiments is typically larger than the maximum gap between joined sections of the tubular assembly 2 (see gap "G" shown in FIG. 5). For other embodiments, width "W" can be less than an inch, but typically ranges from about 2 inches to 12 inches, more typically ranging from about 4 to 8 inches.

The sliding band seal 21 is partially constrained within a channel 22 located on the exterior surface of the isolator body 15. The channel 22 has a length "L" (as measured along the cylindrical axis of the isolator body) slightly greater than the width "W" of the sliding band seal 21, typically about ¼ inch larger than width "W."

The depth of channel 22 (the thickness dimension measured in a substantially radial direction) is related to the thickness of sliding band seal 21, also measured in a substantially radial direction, since the channel must at least partially restrain the sliding band seal. The thickness of sliding band seal 21 shown is about 0.2 inch, but in other embodiments, the sliding band seal thickness can be one inch or more. The depth of the channel 22 typically allows the sliding band seal to contract to its minimum diameter without protruding beyond the outside diameter of the isolator body, e.g., the channel depth is typically slightly more than the thickness of the sliding band seal 21 which can be compressed to an outside diameter no more than slightly greater than the outside diameter of the isolator body.

The sliding band seal 21 is also chamfered or rounded at the corner "C" (see FIG. 4) and its other corners. The chamfered or rounded corners allow the sliding seal band to more easily slide over gaps "G" (see FIG. 5) or other discontinuities on the inside surface of wellbore tubular assembly 2 (see FIG. 2) as the isolator body 15 (see FIG. 4) slides within the wellbore tubular assembly. Chamfer angle (or angle of a small flat surface at the chamfered corner measured from one of the major corner surfaces) can typically range from about 15 degrees to 75 degrees, but is more typically about 45 degrees.

Figure 3:
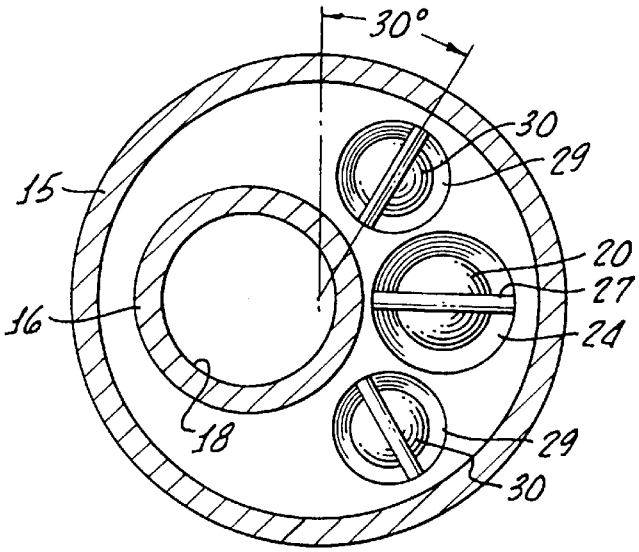
FIG. 3 shows a bottom view of the isolator shown in FIG. 2.

FIG. 3 shows a cross sectional view from section 3—3 shown in FIG. 2. The isolator embodiment shown has three restrictable passageways, one larger diameter restrictable passageway 24 and two smaller diameter restrictable passageways 29. The two smaller diameter restrictable passageways 29 are located on either side of the larger diameter restrictable passageway 24. The plurality, different sizes, and placement of the restrictable passageways 24 and 29 allow restrictable fluid flow when the balls or other means for restricting flow are in the "open" positions. In the embodiment shown, the two smaller diameter restrictable passageways 29 each have a diameter of about ¾ inch, are restrictable by balls having a diameter of about 0.6 inch, and are located at a 30 degree angle from the line connecting the eccentric tubing passageway centerline and the centerline of the larger diameter passageway 24. The smaller diameter restrictable passageways 29 are restricted by smaller diameter balls 30 when the balls are in the "closed" position. The smaller diameter restrictable passageways can typically range to as much as 2 inches in diameter with a corresponding ball diameter of about 1.9 inches. Pins, such as pin 27, constrain and prevent excessive axial motion of the balls 20 and 30.

Another embodiment of the isolator of the invention can include additional restrictable passageways, e.g., located adjacent to and having a diameter still smaller than the two smaller diameter passageways 29 shown in FIG. 3. Still another embodiment can include a non-circular-shaped restrictable passageway in place of the multiple (and progressively smaller diameter) circular restrictable passageways 24 and 29, e.g., having a crescent-shaped restrictable passageway closed by a crescent-shaped valve element.

FIG. 4 shows a perspective view of the sliding seal isolator assembly 12 shown in FIG. 2. A sliding band seal 21 is split in more than a single (two vertical and one horizontal) plane in the embodiment shown, i.e., forming a split staggered surface. The multi-planar split portions 28 form matable surfaces, allowing the sliding band seal 21 to slidably seal at bends or other locations where the inside diameter of wellbore tubular assembly 2 is out-of-round, and/or is significantly different from nominal, and/or has been altered by installation distortion or buckling, subsurface formation pressures, and unremovable deposits.

The matable and staggered split surfaces 28 form a narrow tortuous path for fluids when the sliding band seal 21 is placed in channel 22 within tubular section 13 of tubular assembly 2, effectively restricting fluid flow around the isolator body 15 between the upper annulus 25 and the lower annulus 26 as shown in FIG. 2. The portions of the staggered split surfaces 28 which are more perpendicular to the circumferential axis of isolator body 15 than other surface portions are typically the most restrictive to fluid flow when the sliding band seal 21 is installed. Other embodiments of the non-planar split surfaces of sliding band seal 21 include interlaced-finger-shaped surfaces, and lapped mating surfaces substantially parallel to the exterior surface of isolator body 15 when installed. Other embodiments of the invention can include a gap filler (e.g., a high temperature putty) placed on the split surfaces 28 of the sliding band seal 21 and/or in channel 22), multiple sealing bands, and a bias element tending to force the sealing band radially outward.

Other embodiments of the sliding band seal 21 can include solid but deformable sealing bands, pressure actuated seals such as high temperature O-rings or bands (which can migrate outward out of a groove or channel past a gap at a wellbore tubular joint to seal the annulus between the downstream wellbore tubular section and isolator body), hollow inflatable sealing bands with a reinforced slidable exterior surface, deformable high temperature elastomer or "rubber" cups having extended lips or tubular assembly contact area to span jointed gaps, and telescoping circumferential bands.

FIG. 5 shows an alternative isolator assembly 31 within a wellbore tubular assembly 2. The alternative isolator assembly 31 comprises an alternative isolator body 15*a* having a channel 22 on the radially outward facing surface, a sliding band seal 21 located mostly within channel 22, a ported restrictor element 32 that is control-pressure actuated, an O-ring 33 or other means for sealing control fluid within the isolator assembly, a spring 34 or other bias element, a spring stop element 35, and an internal body 36 having a (formation or injection) fluid passageway connectable to tubing 5. The alternative isolator assembly 31 is shown in the "open" position, threadably connected to sections of tubing 5 and control fluid tubing 37. When fluid isolation of the portions of the wellbore adjacent to producing zones (items 3 and 4 shown in FIG. 1) is desired, control fluid pressure is reduced in the control fluid tubing 37, allowing the spring 34 to actuate the ported restrictor element 32 upward, blocking circumferential ports 38, i.e., actuating to the "closed" position of the alternative isolator assembly. When unrestricted annular flow between zones is desired again, the control fluid pressure is increased sufficiently to force the ported restrictor element 32 downward against the resistance of the spring 34 and spring stop 35 (which is threadably attached to the internal body 36 and alternative isolator body 15*a*), opening circumferential ports 38. This assembly configuration results in a fail-safe or normally closed position for the restrictable passageway, i.e., the loss of control pressure will cause the spring to actuate to the "closed" position and formation or injected fluid is restricted from flowing to/from the annulus (between tubular assembly 2 and tubing 5) and the interior of tubing 5.

FIG. 5 also shows the sliding band seal 21 restricting the flow of fluids around the alternative isolator assembly 31 when the isolator slides within tubular assembly 2 alongside a coupling 39 joining two sections 13 of the tubular assembly 2. Gap "G" between sections 13 joined by coupling 39 can vary from essentially no gap for abutting sections to as much as 6 inches or more for typical diameter tubulars, but the gap more typically ranges from about 3 to 4 inches for tubing diameters of 5 inches or less. The gap "G" is typically a function of tubular connector type and the nominal diameter of the tubular sections, e.g., an 8 inch gap is possible for a butt threaded connector connecting large diameter tubulars.

Figure 6:
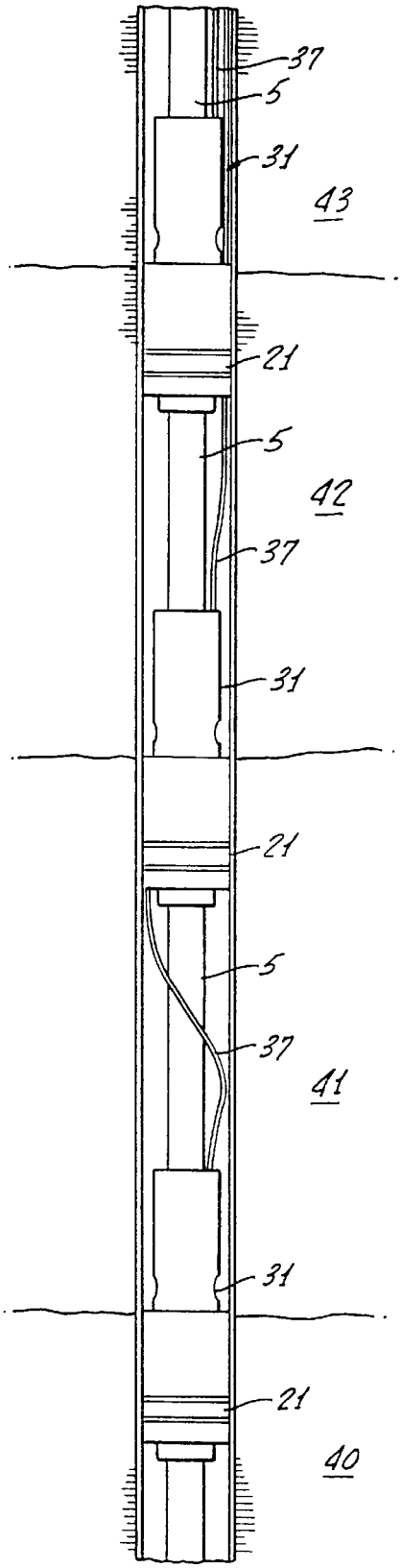
FIG. 6 shows a cross sectional view of three alternative isolators in a wellbore.

FIG. 6 shows three alternative isolator assemblies 31 placed in a portion of tubular assembly 2 such that each adjoining isolator pair separates portions of the perforated wellbore tubular assembly adjacent to subsurface oil-producing zones 40 through 43. A fluid, such as steam, introduced into tubing 5 can be injected into only one zone, e.g., steam injected into only zone 40 when all alternative isolator assemblies 31 are in the "closed" position, or into multiple zones, e.g., steam injected into zones 40 and 41 through tubing 5 when the lowest alternative isolator assembly is in the "open" position and the remaining alternative isolator assemblies are in the "closed" position. Producing oil through tubing 5 from one or more zones 40 through 43 can be similarly controlled by opening or closing ports 38 (see FIG. 5) of each alternative isolator assembly 31. Separate control-fluid tubing 37 is shown connected to each isolator assembly 31 allowing individual control of each isolator assembly and the flow of formation or injection fluids into or out of each zone.

Alternative embodiments of the invention include using a combination of isolator embodiments and interconnections of these isolators. For example, both a "check valve" isolator assembly 15 as shown in FIG. 2 and an actuated or alternative isolator assembly 15*a* as shown in FIG. 5 can be installed in a tubular. Actuated isolators may also be normally "open" position isolators (e.g., where a spring tends to open ports 38 instead of closing ports 38 as shown in FIG. 5) as well as normally closed isolators. If all isolators are to be actuated into similar positions during operations, fluid control lines 37 may be interconnected instead of separate as shown in FIG. 6.

Isolating portions of a wellbore tubular assembly using a slidable seal isolator of the invention avoids the need for mechanically actuating a packer to seal off a portion of the wellbore tubular assembly in order to steam a selected portion of a formation. The invention also avoids removing the packer to produce commingled formation fluids.

The process of installing an isolator embodiment of the invention into a wellbore involves several steps. A scraper, e.g., a "Possie Gauge" scraper, is run through the wellbore tubulars to remove debris from the interior of the tubulars and to assure that a flow isolator or restrictor apparatus having a slightly smaller outside diameter can slide within the tubular assembly. Scraping also tends to clean perforations leading from the wellbore to oil production and/or steam injection zones. If the wellbore and perforations are known to be clean, this scraping step can be omitted.

Next, an isolator is made up or assembled to the tubing or other fluid conductor and run into the wellbore to a zone separation depth, e.g., using a drilling rig to run and support the tubing. The isolator is supported by and/or inserted into the wellbore using the tubing. The assembly and running step typically includes threadably attaching the isolator to the top end of a forty foot long section of tubing, inserting the isolator and attached tubing section into the wellbore until the unattached end is close to being inserted, threadably attaching one end of another tubing section to the exposed end of the nearly fully inserted tubing section, and continuing to insert and/or lower the tubing/isolator assembly until the isolator is desirably located near a position above or below a fluid producing or injecting zone.

Inserting the isolator may initially require compressing the slidable band seal and applying an inserting (downward) force to the isolator since force may be required to overcome the frictional resistance of the sealing band sliding on the inside surface of the wellbore tubular assembly. Typically, after about one or two tubing sections are inserted into substantially vertical portions of a wellbore, the frictional resistance will typically be overcome by the weight of the assembly and the slidable sealing isolator assembly can be conventionally lowered into the wellbore assembly without an inserting force.

In the third step of the installation process, the tubing is hung off, typically at or near the surface on a tubing hanger or donut within the tubular. Hanging off supports the tubing/isolator assembly without the need for a drilling rig, but does not "set" the position of the isolator relative to the tubular near the zone of interest. Instead, the hung-tubing-supported isolator is allowed to move relative to the adjacent portion of the wellbore tubular assembly. Relative movement may be caused by differential thermal expansion or contraction or other differential stresses/strains, and the relative movement is accommodated by the slidable band seal without a substantial loss of fluid isolation/restriction capability.

In the fourth step of the installation process, the means for producing oil or other formation fluids and means for injecting steam or other injectable fluid are connected to the tubing and/or wellbore tubular assembly. The means for injecting steam is typically a steam generator and steam piping located at the surface connected to the tubing. The means for producing oil may include the collection and transmission of produced oil, e.g., piping, storage tanks and pumps connected to the annulus between the tubing and wellbore tubular assembly. Means for producing oil may also be connected to the tubing in a "huff and puff" operation.

Once an isolator embodiment of the invention is installed in the wellbore tubular assembly pursuant to the installation procedure described above, it can be used to selectively treat portions of the formation with a fracture, solvent, thermal or other injectable fluid, including a fluid-solids mixture, to efficiently and economically recover oil or other formation fluids. A solvent, a thermal fluid, or other recovery-assisting fluid is injected into a portion of the well isolated by one or more isolators and into at least a first underground zone. Oil or other formation fluid production from another zone may occur simultaneously while injected fluid such as steam is introduced into the first zone. In a steam thermal recovery process using a slidable seal isolator having a ball in a restrictable passageway acting as a "check valve" (similar to that shown in FIGS. 2–4) and located between a deep low-permeability zone and a shallow higher-permeability zone, steam is injected through the tubing 5 into the deep zone adjacent to lower annulus 26. The check valve prevents substantial steam flow into the upper annulus 25. If a portion of the total steam needs to be injected into the shallow zone, steam can be separately injected into upper annulus 25 between the tubing and wellbore tubular assembly, and this portion of total steam will be prevented from flowing into the deep zone as long as the pressure in the tubular below the isolator is enough to keep the ball 20 in the closed position.

Referring to the embodiment shown in FIG. 2, oil or other formation fluid (e.g., by itself or mixed with an injected fluid) can be produced from the shallow zone through upper annulus 25 while steam is injected into the deeper zone through the tubing 5 as long as the pressure in the wellbore tubular assembly below the isolator is enough to keep the ball 20 in the closed position. Commingled oil can also be produced when produced oil from the shallow zone is allowed to flow down annulus 25 and through "open" ball restrictable passageway 24 in isolator 12 into lower annulus 26 where it mixes with oil produced from the lower zone, and the mixture is allowed to flow (or is pumped) up to the surface through the tubing 5. Simultaneous formation fluid production from all or most producing zones is most common even though a thermal or other recovery fluid may only be injected into selected zones or different controlled amounts and flow rates of recovery fluids are injected into different zones.

A two zone test conducted as described above produced more than double the amount of oil per initial thermal cycle when compared to oil production per initial thermal cycle without a test isolator. Initial cycle test results also showed that about half of the total steam was injected into each zone as compared to only about 4 percent of the steam being injected into the deeper, less permeable zone without the slidable seal isolator.

The reasons for the significant increase in test oil production may be related to other advantages of the isolator and the inventive method of using the isolator. Similar to when using a packer, steam is prevented from flowing into an upper zone, while steam pressure applied to a lower wellbore portion and lower zone can be increased sufficiently to fracture the deep, low permeability zone. However, unlike a packer which must be removed if produced oil from above the packer must be pumped through tubing, the isolator allows heated oil production from both zones to begin before the fractures fully close as well as before the heated oil has a chance to cool. Since produced oil from upper zones may also contain a higher proportion of lighter hydrocarbons, mixing of produced oils from more than one zone in the wellbore may also contribute to increased oil production, e.g., heavy oils from a lower zone may not be pumpable below a certain elevated temperature but the mixture of heavy and light crude oils from each zone may be pumpable at a lower elevated temperature. In addition, increasing the steam pressure to a desired fracture pressure deep in the formation in several productive zones may not be possible without isolators allowing steam flow first into a first wellbore portion and adjacent zone followed by steam flow into another wellbore portion and adjacent zone because of one or more "thief zones." The thief zones may divert steam into a gas cap where little oil recovery benefits from the injected steam are derived.

If an actuatable restrictor embodiment of the isolator (similar to that shown in FIG. 5) is used, formation fluid (e.g., oil) is produced or recovery fluid (e.g., steam) is injected through the tubing into an isolated portion of the wellbore tubular assembly when the isolator is in the open position. Simultaneous fluid injection and production to and from different zones is not normally accomplished using the actuatable embodiment shown in FIG. 5 since this isolator embodiment of the invention has only one fluid passageway, extending from an upper surface to a lower surface of the alternative isolator 31.

Although use of an actuatable packer and tubing assembly may achieve steam injection results similar to those obtained using the slidable isolator of the invention, oil production is not expected to be similar because use of the slidable isolator obviates the need to remove packers, avoiding cost and delay between steam injection and oil production. This advantage can be especially important when three or more oil producing zones are involved. In addition, the slidable band seal of the isolator avoids the need to expandably actuate, set, and test the sealing ability of a packer. The slidable band seal also allows the isolator assembly to seal against fluid flow even when the isolator is located near a gap between joined tubular sections.

One embodiment of an alternative method of the invention is to use a ball or other check-valve type of isolator as an element of a blowout preventor system, e.g., sliding an isolator to a shallow location within the perforated wellbore tubular portion above the uppermost producing zone and producing through the tubing/injecting through the annulus unless a blowout pressure is detected. If blowout pressure is detected, tubing could be pinched off and reverse flow in the annulus automatically prevented by the isolator's ball or other restrictor device. The annulus and restrictable passageway could also be used to inject dense "kill" or other fluid into the high pressure portions of the perforated wellbore adjacent to the producing zones. Another embodiment avoids eccentric reducers if the size of tubing is substantially less than the wellbore tubular size, allowing annular restrictor passageway(s) without offsetting the tubing passage away from the centerline of the isolator.

Another alternative embodiment of the isolator of the invention involves the shape of the sliding band seal 21. Instead of the substantially rectangular cross sectional shape of the sliding band seal 21 shown in FIG. 2, the cross sectional shape can be substantially altered, e.g., a triangular, elliptical, tear-drop, or other alternative shape with the longest dimension of these alternative shapes typically being parallel to the axis of the isolator. These alternative shapes continue to allow sealing across gap "G" as shown in FIG. 5 assuming the dimension of the contacting surface portion of the alternative shape exceeds gap "G" dimensions. The alternative sliding band seal may also twist to improve sealing characteristics when the interior tubular surface is irregular. The non-rectangular cross-section or alternative shape may also allow the sliding band seal to more easily slide across gaps and other irregularities on the inside surface of the well tubular assembly.

Another alternative configuration embodiment of the method of the invention is to install an actuated isolator at the bottom of the tubing and plug the tubing below the isolator. This allows the operator of the isolator configuration to selectively steam into and produce from the lowest zone or portion of the well.

Another alternative embodiment of the method of the invention is to provide tubing 5 composed of two different diameter tubing strings or tubing portions near an isolator. The upper, large diameter tubing may extend from the surface or a subsurface location down to a lower tubing portion within a short distance (e.g., 10 feet) above an optional downhole tubing pump. (See optional item "PMP" in FIG. 1.) The comparatively short length of a second, smaller diameter tubing string is attached at the bottom of the large tubing string and includes a pump seat. Before steaming down the tubing, the optional pump can be pulled off the pump seat (in the small diameter tubing string portion) and raised a short distance into the large diameter tubing string portion. Raising the optional pump into the large diameter tubing allows fluid to flow around the optional pump instead of removing the optional pump completely from the tubing to allow steaming.

While a preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method for recovering one or more formation fluids from a plurality of subsurface zones penetrated by a wellbore tubular, said method comprising:

placing a fluid isolator having a first passageway and a restrictable passageway at a wellbore location within said wellbore tubular such that said isolator is capable of conducting a formation fluid from a first zone to a surface location through said first passageway while substantially restricting the flow of a formation fluid from a second zone to the surface location through said restrictable passageway; and conducting a substantial flow of a formation fluid from said second zone to said surface location, wherein said second fluid flows through said restrictable passageway in said isolator when located at said wellbore location.

2. The method of claim 1 wherein said isolator is also capable of relative motion with respect to said wellbore tubular while substantially restricting the flow of a formation fluid from said second zone towards said surface location.

3. The method of claim 1 which also comprises the step of:

introducing an injection fluid into said first zone while said isolator substantially restricts the introduction of said injection fluid into said second zone.

4. The method of claim 3 wherein said placing, conducting, and introducing steps are accomplished in the absence of a radially outward actuation of an isolator mechanism.

5. The method of claim 1 wherein said wellbore tubular is composed of threaded pipe sections and threaded pipe section connectors, and wherein said isolator is capable of substantially restricting the flow of a formation fluid from one of said zones from being conducted towards said surface location when said isolator is adjacent to one of said pipe section connectors.

6. The method of claim 3 wherein said injection fluid comprises steam and said formation fluid from both zones comprises oil.

7. A method for recovering one or more formation fluids from a first subsurface zone and a second subsurface zone penetrated by a wellbore tubular, said method comprising:

sliding a fluid isolator having a restrictable passageway to a location within said wellbore tubular such that said isolator is capable of conducting a formation fluid from a first space within said wellbore tubular proximate to said first zone towards a surface location while substantially restricting the flow of a formation fluid from a second space within said wellbore tubular proximate to said second zone towards the surface location; and conducting a substantial amount of a formation fluid from said second zone to said surface location, wherein said formation fluid flows through said restrictable passageway in said isolator when located at said location.

8. An apparatus for controlling the introduction of an injection fluid into and the production of a formation fluid from a first subsurface zone penetrated by a first portion of an underground wellbore tubular, and the production of a formation fluid from a second subsurface zone penetrated by a second portion of an underground wellbore tubular, said apparatus comprising:

a substantially cylindrical isolator capable of conducting a flow of injection fluid towards said first portion while restricting injection fluid from flowing towards said second portion when said isolator is placed at a location within said underground tubular;

means for introducing said injection fluid into said first zone; and means for producing formation fluids from said second zone through said isolator.

9. The apparatus of claim 8 wherein said isolator is capable of slidably sealing said first portion from said second portion such that fluid transfer between said wellbore portions is substantially prevented when said isolator is sliding relative to said wellbore tubular.

10. The apparatus of claim 9 which also comprises means for sliding said isolator within said wellbore tubular.

11. The apparatus of claim 8 wherein said wellbore tubular is composed of pipe sections having substantially cylindrical inside surfaces and at least one section joint having an irregular inside surface over a gap length measured along a cylindrical axis, wherein said isolator comprises:

a split band-seal;

an isolator body; and a seal-retaining channel located circumferentially around a radially outward facing surface of said isolator body, said channel capable of retaining said split band-seal when said isolator body and said split band-seal are slid past said inside surface, said split band-seal having split surfaces separated when said band-seal is unrestrained and capable of being mated when said band-seal is restrained, said band-seal having a length measured parallel to said cylindrical axis of no less than about said gap length.

12. A fluid control apparatus for use in a wellbore tubular assembly located below a surface, said tubular assembly containing joints at connected tubular sections, said apparatus comprising:

a substantially cylindrical isolator capable of restrictably transmitting a fluid towards a first space within said wellbore tubular assembly and restricting the flow of said fluid towards a second space within said wellbore tubular assembly when said isolator is slidably placed near one of said joints; and tubing connected to said isolator and extending towards said surface.

13. A fluid flow controller comprising:

a substantially cylindrical body having a channel and adapted to be slidable within a tubular joint having a gap dimension between joined tubular sections; and a slidable band seal element at least partially restrained by said channel and said joint, wherein said slidable seal element has a width dimension that is greater than said gap dimension.

14. The apparatus of claim 13 which also comprises:

a fluid passageway in said cylindrical body extending from one end to a distal end, said ends separated along the cylindrical axis; and means for controlling the flow of a fluid through said fluid passageway.

15. The apparatus of claim 14 wherein said means for controlling comprises a ball located in said fluid passageway.

16. The apparatus of claim 15 wherein said means for controlling also comprises a ball catch element attached to said isolator body so as to block motion of said ball in one direction within said passageway.

17. The apparatus of claim 16 wherein said ball catch apparatus comprises a pin diagonally extending across said passageway.

18. The apparatus of claim 15 wherein said means for controlling comprises a spring contacting said cylindrical body and said ball.

19. The apparatus of claim 14 wherein said fluid is a recovery fluid and said means for controlling comprises:

a source of control fluid;

a control fluid passageway connected to said source of control fluid;

a translatable member actuated by control fluid pressure and capable of restricting the flow of said recovery fluid in one position and transmitting the flow of said recovery fluid in a second position.

20. The apparatus of claim 14 wherein said apparatus is capable of sliding to another position within said tubular sections while restricting the flow of said fluid in the absence of a radially actuated mechanism.

21. The apparatus of claim 14 which also comprises an eccentric reducer connected to said cylindrical body.

22. The apparatus of claim 14 which also comprises a plurality of said fluid passageways, wherein said fluid passageways are substantially cylindrical and at least two of which have significantly different passageway diameters.

23. The apparatus of claim 22 which also comprises means for restricting each of said fluid passageways.

24. An apparatus for conducting an injection fluid into a lower portion of a wellbore tubular and for conducting a formation fluid out of an upper portion of said wellbore tubular, said apparatus comprising:

a substantially cylindrical body designed to restrict the flow of said injection fluid into said upper portion when placed within said wellbore tubular; and means in said body for conducting said formation fluid from said upper portion through said cylindrical body to said lower portion.

25. The apparatus of claim 24 wherein said cylindrical body is designed to slidably restrict the flow of said injection fluid.

26. A system for producing one or more formation fluids by separately injecting a recovery fluid into upper and lower subsurface zones penetrated by a wellbore tubular, said system comprising:

a substantially cylindrical control restrictor located in said wellbore tubular so as to slidably seal said upper zone from said lower zone, said control restrictor capable of both substantially restricting the flow of said recovery fluid from said lower zone to said upper zone and allowing the flow of a formation fluid from said upper zone through said isolator into said lower zone;

means for introducing said recovery fluid into said lower zone; and means for passing formation fluid from said upper zone through said isolator.

27. An isolator for controlling fluid flow within a wellbore tubular which extends along an axis, said isolator comprising:

a substantially cylindrical isolator body having an radially outward facing surface capable of contacting said wellbore tubular when said isolator is placed within said wellbore tubular and is supported by attached tubing;

a first passageway extending substantially parallel to said axis from an upper surface of said isolator body to a lower surface of said isolator body, said first passageway capable of conducting fluid passing through said attached tubing; and a second restrictable passageway extending substantially from said upper surface to said lower surface.

28. The isolator of claim 27 which also comprises third and fourth restrictable passageways extending between said upper and lower surfaces.

* * * * *